US009702045B2

(12) United States Patent
Myllymaki et al.

(10) Patent No.: US 9,702,045 B2
(45) Date of Patent: Jul. 11, 2017

(54) METALLIC COATING AND A METHOD FOR PRODUCING THE SAME

(71) Applicant: Carbodeon Ltd Oy, Vantaa (FI)

(72) Inventors: Vesa Myllymaki, Helsinki (FI); Niko Rostedt, Helsinki (FI)

(73) Assignee: CARBODEON LTD OY, Vantaa (FI)

( * ) Notice: Subject to any disclaimer, the term of this patent is extended or adjusted under 35 U.S.C. 154(b) by 0 days.

(21) Appl. No.: 14/791,902

(22) Filed: Jul. 6, 2015

(65) Prior Publication Data

US 2017/0009350 A1 Jan. 12, 2017

(51) Int. Cl.

| | |
|---|---|
| ***C23C 18/34*** | (2006.01) |
| ***C23C 18/36*** | (2006.01) |
| ***C23C 18/40*** | (2006.01) |
| ***C23C 18/44*** | (2006.01) |
| ***C23C 18/48*** | (2006.01) |
| ***B82Y 30/00*** | (2011.01) |
| ***C23C 18/16*** | (2006.01) |

(Continued)

(52) U.S. Cl.

CPC ..... *C23C 18/34* (2013.01); *C23C 18/1662* (2013.01); *C23C 18/1696* (2013.01); *C23C 18/1844* (2013.01); *C23C 18/32* (2013.01); *C23C 18/36* (2013.01); *C23C 18/38* (2013.01); *C23C 18/42* (2013.01); *C23C 18/48* (2013.01); *C23C 18/50* (2013.01); *C25D 3/04* (2013.01); *C25D 3/12* (2013.01); *C25D 3/20* (2013.01); *C25D 3/38* (2013.01); *C25D 3/46* (2013.01); *C25D 3/48* (2013.01); *C25D 3/50* (2013.01); *C25D 5/12* (2013.01); *C25D 5/34* (2013.01); *C25D 5/50* (2013.01); *C25D 15/00* (2013.01); *C25D 5/18* (2013.01)

(58) Field of Classification Search

CPC ..... C23C 18/34; C23C 18/36; C23C 18/40; C23C 18/44; C23C 18/48; B82Y 30/00

USPC ..... 106/1.22, 1.23, 1.24, 1.25, 1.26, 1.27, 106/1.28

See application file for complete search history.

(56) References Cited

U.S. PATENT DOCUMENTS 5,861,349 A * 1/1999 Vereschagin ..... B01J 3/08 423/446

6,156,390 A 12/2000 Henry et al.

(Continued)

FOREIGN PATENT DOCUMENTS

EP 1288162 A3 5/2007

EP 2216642 A1 8/2010

(Continued)

OTHER PUBLICATIONS

Finnish Patent and Registration Office Search report dated Jan. 29, 2016 for Finnish patent appln. No. 20155534.

(Continued)

*Primary Examiner* — Helene Klemanski

(74) *Attorney, Agent, or Firm* — Berggren Inc.

(57) ABSTRACT

The present invention relates to metal plating solution comprising at least one source of metal ions and detonation nanodiamonds, wherein the detonation nanodiamonds are substantially free of negatively charged functionalities, and to a method for producing the solution. The present invention further relates to metal plating method and to a metallic coating comprising metal and detonation nanodiamonds substantially free of negatively charged functionalities.

21 Claims, 3 Drawing Sheets

(51) Int. Cl.

| | |
|---|---|
| ***C23C 18/18*** | (2006.01) |
| ***C25D 3/04*** | (2006.01) |
| ***C25D 3/12*** | (2006.01) |
| ***C25D 3/20*** | (2006.01) |
| ***C25D 3/38*** | (2006.01) |
| ***C25D 3/46*** | (2006.01) |
| ***C25D 3/48*** | (2006.01) |
| ***C25D 3/50*** | (2006.01) |
| ***C25D 5/12*** | (2006.01) |
| ***C25D 5/34*** | (2006.01) |
| ***C25D 5/50*** | (2006.01) |
| ***C25D 15/00*** | (2006.01) |
| ***C23C 18/32*** | (2006.01) |
| ***C23C 18/38*** | (2006.01) |
| ***C23C 18/42*** | (2006.01) |
| ***C23C 18/50*** | (2006.01) |
| *C25D 5/18* | (2006.01) |

(56) References Cited

U.S. PATENT DOCUMENTS

| | | | | |
|---|---|---|---|---|
| 7,115,325 | B2 * | 10/2006 | Fujimura | C25D 15/02 428/323 |
| 2003/0228249 | A1 * | 12/2003 | Fujimura | C25D 15/02 423/446 |
| 2004/0011433 | A1 * | 1/2004 | Shiozaki | C25D 15/02 148/400 |
| 2008/0127475 | A1 | 6/2008 | Griffo | |
| 2011/0006218 | A1 * | 1/2011 | Mochalin | B82Y 30/00 250/459.1 |
| 2015/0050207 | A1 * | 2/2015 | Dolmatov | C01B 31/065 423/446 |
| 2016/0068398 | A1 * | 3/2016 | Myllymaki | C01B 31/065 508/122 |
| 2016/0102188 | A1 * | 4/2016 | Myllymaki | C08K 3/38 252/75 |
| 2016/0115033 | A1 * | 4/2016 | Myllymaki | B01J 13/0026 516/32 |

FOREIGN PATENT DOCUMENTS

| | | |
|---|---|---|
| JP | 2008214672 A | 9/2008 |
| KR | 100795166 | 1/2008 |
| WO | 2011089933 | 7/2011 |
| WO | 2014/174150 | 10/2014 |
| WO | 2014/191633 | 12/2014 |
| WO | 2015/092142 | 6/2015 |
| WO | 2015097347 A2 | 7/2015 |

OTHER PUBLICATIONS

Finnish Patent and Registration Office Office Action dated Jan. 29, 2016 issued in Finnish patent appln. No. 20155534.

European Patent Office, International Search Report issued on Sep. 13, 2016 for PCT/FI2016/050501.

* cited by examiner

METALLIC COATING AND A METHOD FOR PRODUCING THE SAME

TECHNICAL FIELD

The present invention relates to metal plating solutions and to a method for producing the metal plating solutions. The present invention further relates to plating methods, and to metallic coatings.

BACKGROUND ART

Plating is a process used by deposition of metals upon a surface from an aqueous solution (electrolyte) containing metal salts. Said process may take place electrolytically (applying an electric current) or purely as a chemical reaction (electroless plating) without applying an external current source. Chemical and electrochemical processes can be further subdivided into three different sub-groups: electrolytic plating, autocatalytic plating and ion exchange (displacement plating) plating.

Electroless plating, also known as electroless metal plating or chemical or auto-catalytic plating, involves several simultaneous reactions in an aqueous solution, which occur without use of external electrical power. The reaction is accomplished when hydrogen is released by a reducing agent, normally sodium hypophosphite, and oxidized, thus providing a negative charge on the surface of the part. The most common electroless metal plating method is electroless nickel plating, although for example silver, gold and copper layers can also be applied in this manner.

Electroless nickel plating (EN) is an auto-catalytic chemical technique used to deposit a layer of nickel-phosphorus or nickel-boron alloy on a solid substrate, such as metal, ceramic or polymer material. The process relies on the presence of a reducing agent, for example hydrated sodium hypophosphite ($NaPO_2H_2.H_2O$) which reacts with the metal ions to deposit metal.

Alloys with different percentage of phosphorus are called low phosphorus, medium phosphorus (sometimes referred as mid-phosphorus) and high phosphorus. The metallurgical properties of the alloys depend on the percentage of phosphorus.

A common form of electroless nickel plating produces a nickel phosphorus alloy coating. The phosphorus content in electroless nickel coatings can range for example from 2% to 13%. It is commonly used in engineering coating applications where wear resistance, hardness and corrosion protection are required. All the Ni—P types can be applied with uniform coating thickness, also on most complicated surfaces. The wear and hardness properties of resultant coatings are greatly affected by not only the bath composition but also the deposition temperature, pH and age of the bath. Electroless nickel plating layers are known to provide extreme surface adhesion when plated properly. Electroless nickel layers are not easily solderable, nor do they seize with other metals or another electroless nickel plated work piece under pressure. Electrical resistance is higher compared to pure metal plating.

Electroless nickel plating baths are sensitive for metallic and organic impurities. Even very low levels of these impurities can cause failure in plating, such as dullness, pitting or the bath may plate out spontaneously.

Electrolytic plating, also known as electroplating, is the most widely applied use of plating technique. It requires an external power source and the plating is normally carried out with the entire surface area immersed in a liquid. The metal source consists of metal ions and possibly also metal anodes, which will be continuously dissolved as the metal plating takes place. In some cases the anode is just an inert conducting electrode made from, e.g. platinum-coated titanium or graphite (known as dimensionally stable anodes, DSA), where the metal ions are only supplied from the electrolyte which is gradually consumed and it is therefore necessary to frequently add more ions to the electrolyte (replenish).

Typical industrial electroplated coatings include hard chrome (also known as hexavalent chrome ($Cr^{6+}$)), decorative chrome and various nickel coatings.

Hard chrome's main applications can be found within oil & gas industries, automotive and aerospace industries and on various industrial machinery parts. One functional disadvantage of hexavalent chromium plating is low cathode efficiency, which results in bad throwing power. Hence, the coatings become non-uniform, the coating thickness being higher at plated component edges. To overcome this problem the part may be over-plated and ground to size, or auxiliary anodes may be used around the hard-to-plate areas. Altogether, this results in high electricity consumption and cost. From a health standpoint, hexavalent chromium is the most toxic form of chromium. In the U.S. the Environmental Protection Agency (EPA) regulates it heavily. The EPA lists hexavalent chromium as a hazardous air pollutant because it is a human carcinogen, a "priority pollutant" under the Clean Water Act, and a "hazardous constituent" under the Resource Conservation and Recovery Act. Due to its low cathodic efficiency and high solution viscosity a toxic mist of water and hexavalent chromium is released from the bath. Due to significant health risks, European Union is to ban or severely restrict the use of hard chrome within its territory.

Trivalent chromium is an alternative to hexavalent chromium plating in certain applications and thicknesses, e.g. decorative plating. Plating thickness is significantly thinner than with hard chrome. Said coating thickness is limited due to strain and subsequent coating delamination generated due to absence of strain releasing cracking typical in hard chrome plating. From a health standpoint trivalent chromium is intrinsically less toxic than hexavalent chromium. The disadvantages include its limited thickness and thus wear and corrosion resistance properties, the need to use various additives to adjust the coating color, and its sensitivity with respective to metallic impurities.

Gold plating is a method of depositing a thin layer of gold typically on copper or silver. Gold can be deposited by electrolytic and electroless means. There are several standards in which gold platings can be divided, but often they are divided into pure and hard gold which can be further divided based on their pH level or whether they contain cyanide or not. The wear resistance and hardness of pure gold coating is poor, typically below 130 HV. Gold hardness properties can be improved by alloying said gold coatings with transition metals, most often using cobalt or nickel. The hardness of hard gold is between 120-300 HV. Hard gold can only be produced from acidic cyanide based baths. Cobalt or nickel hardened gold cannot be used in semiconductor industry for die bonding because they interfere with the process. European Union is however having plans to ban the use of cobalt alloys and thus, there is an identified need for improving the gold coating wear and corrosion resistance properties by other means. As improved coating wear resistance would facilitate thinner coating thicknesses without compromising on the coating lifetime, significant savings in gold material and processing costs could be achieved.

As the electrical conductivity of silver is higher than that of copper, silver is often times applied as a top coat on copper, within electronics applications. This is valid especially in high frequency applications, due to skin effect.

When the silver layer is porous or contains cracks, the underlying copper readily subjected to galvanic corrosion, flaking off the plating and exposing the copper itself; a process known as red plaque. Hence, improvements in silver-plated coating corrosion resistance would improve the coating lifetime. Moreover, improved coating wear and corrosion resistance would facilitate thinner coating thicknesses without compromising on the coating lifetime and significant savings in silver material and processing costs could be achieved.

Nickel phosphorous coatings can also be plated electrolytically. The coatings typically contain around 11-13% of phosphorous which explains the good corrosion resistance of the coatings. The hardness of electrolytic NiP coating is typically around 550-600 HV. The advantage over electroless nickel phosphorous plating is e.g. that the plating rate and thickness can be controlled easier, metal additions are not necessary because of soluble nickel anodes and the there is no plate out of nickel.

Electroplated nickel-silicon carbide composite coatings are used for example in two-stroke engines as cylinder bore coatings. The process is commonly known as Nikasil-process. The coatings generally have higher wear resistance than regular nickel coatings, but the work-piece touching the surface will wear out quickly due to the nature of the irregularly shaped SiC-particles, unless lubrication is used. The silicon carbide particles (Nikasil) co-deposited in the coating improve the plated nickel coating's affinity to oils and lubricants and thus, reduce the overall friction within the friction pair. The bath (electrolyte) SiC particle concentration is typically 40 g/l.

Electrolytic and electroless plating can take place both in acidic, neutral and alkaline conditions, having an impact on various particulate's stability therein. The lower is the particles stability in the electrolyte, the more they have tendency to agglomerate. This issue has traditionally been addressed by increasing the particle additive content and using various suitable surfactants.

Nanodiamonds can be produced by synthetic or detonation processes.

Synthetic nanodiamonds may be produced by several known methods, such as chemical vapour deposition or high pressure high temperature (HPHT) method, followed by crushing and sieving of resulting diamond particles. Such particles particle size distribution (PSD) is wide and the particle size (D50) varies from tens of nanometers to several hundreds of micron size. Nanodiamonds produced this way don't exhibit surface functionalization, nor can their surface be functionalized with covalently bound surface functions. Moreover, their shape is irregular and the particles exhibit hard edges.

Nanodiamonds produced by detonation synthesis are called detonation nanodiamonds. That is, detonation nanodiamonds originate from detonation process.

Detonation nanodiamond, also referred to as ultrananocrystalline diamond or ultradispersed diamond (UDD), is a unique nanomaterial, which can be produced in thousands of kilograms by detonation synthesis.

Detonation nanodiamonds, or nanodiamonds originating from detonation process, were first synthesized by researchers from the USSR in 1963 by explosive decomposition of high-explosive mixtures with negative oxygen balance in a non-oxidizing medium. A typical explosive mixture is a mixture of trinitrotoluene (TNT) and hexogen (RDX), a preferred weight ratio of TNT/RDX is 40/60.

As a result of the detonation synthesis, diamond-bearing soot also referred to as detonation blend is obtained. This blend comprises spherical nanodiamond particles, which typically have an average particle size of about 2 to 8 nm, and different kinds of non-diamond carbon contaminated by metals and metal oxide particles coming from the material of the detonation chamber and used explosives. The content of nanodiamonds in the detonation blend is typically between 30 and 75% by weight.

The nanodiamond-containing blends obtained from the detonation contain same hard agglomerates, typically having a diameter of above 1 mm. Such agglomerates are difficult to break. Additionally the particle size distribution of the blend is very broad, ranging typically from several to tens of microns.

The diamond carbon comprises $sp^3$ carbon and the non-diamond carbon mainly comprises $sp^2$ carbon species, for example carbon onion, carbon fullerene shell, amorphous carbon, graphitic carbon or any combination thereof. In addition, the nanodiamond blend contains metallic impurities originating mainly from the detonation chamber but sometimes also from the applied explosives.

There are number of processes for the purification of the detonation blends. The purification stage is considered to be the most complicated and expensive stage in the production of nanodiamonds.

For isolating the end diamond-bearing product, use is made of a complex of chemical operations directed at either dissolving or gasifying the impurities present in the material. The impurities, as a rule, are of two kinds: non-carbon (metal ions, metal oxides, salts etc.) and non-diamond forms of carbon (graphite, black, amorphous carbon).

Chemical purification techniques are based on the different stability of the diamond and non-diamond forms of carbon to oxidants. Liquid-phase oxidants offer an advantage over gas or solid systems, because they allow one to obtain higher reactant concentrations in the reaction zone and, therefore, provide high reaction rates.

Nanodiamonds have received attention due to several existing applications within for example chemo-mechanical polishing, oils and lubricants additives, various polymer mechanical and thermal composites.

The usability of the detonation nanodiamonds is based on the fact that the outer surface of detonation nanodiamond, as opposite to for example nanodiamonds derived from micron diamonds by crushing and sieving, is covered with various surface functions. Typically detonation nanodiamond surface contains mixture of oppositely charged functions and exhibits thus high agglomeration strength at low overall zeta-potential properties. With agglomeration it is meant the single nanodiamond particles tendency to form clusters of nanodiamond particles, these clusters sizing from tens of nanometers into millimeter-sized agglomerates.

Substantially mono-functionalized nanodiamond possesses, depending on the type of surface functionalization, either a highly positive or negative zeta potential value.

The zeta potential value can be related to the stability of colloidal dispersions. The zeta potential indicates the degree of repulsion between adjacent, similarly charged particles in dispersion or suspension. For molecules and particles that are small enough, a high zeta potential will confer stability, i.e., the solution or dispersion will resist aggregation. When the potential is low, attraction exceeds repulsion and the dispersion will break and flocculate. So, colloids with high zeta potential (negative or positive) are electrically stabilized while colloids with low zeta potentials tend to coagulate or flocculate. If the zeta potential is 0 to ±5 mV, the colloid is subjected to rapid coagulation or flocculation. Zeta potential values ranging from ±10 mV to ±30 mV indicate incipient instability of the colloid (dispersion), values ranging from ±30 mV to ±40 mV indicate moderate stability, values ranging from ±40 mV to ±60 mV good stability, and excellent stability is reached only with zeta potentials more than ±60 mV. One of the common ways to measure the material zeta potential is laser Doppler Micro-Electrophoresis method. An electric field is applied to a solution of molecules or a dispersion of particles, which then move with a velocity related to their zeta potential. This velocity is measured using laser interferometric technique called M3-PALS (Phase analysis Light Scattering). This enables the calculation of electrophoretic mobility, and from this the zeta potential and zeta potential distribution.

Several methods for functionalizing detonation nanodiamonds with different functional groups have been developed. Typical functionalized nanodiamonds are hydrogenated nanodiamonds, carboxylated nanodiamonds, hydroxylated nanodiamonds and amino-functionalized nanodiamonds, For example, PCT/FI2014/050290 discloses a method for producing zeta negative nanodiamond dispersion and zeta negative nanodiamond dispersion, PCT/FI2014/050434 discloses zeta positive hydrogenated nanodiamond powder, zeta positive single digit hydrogenated nanodiamond dispersions and methods for producing the same, and PCT/FI2014/051018 discloses zeta positive amino-functionalized nanodiamond powder, zeta positive amino-functionalized nanodiamond dispersion and methods for producing the same.

In the recent years nanodiamonds have received more attention in the field of electroless plating in attempts to increase for example wear of the electrolessly plated metal coating.

KR 100795166 B1 discloses electroless coating method using a nanodiamond powder solution improving hardness, wear resistance, and corrosion resistance of a metal. The method includes i) inserting nanodiamond powder to water at room temperature; ii) dispersing the nanodiamond powder solution by using ultrasonication; and iii) inserting the dispersed nanodiamond powder solution into an electroless nickel coating solution by utlrasonication.

WO 2011/089933 discloses a process for producing a composite plating solution and depositing diamond microparticles in a metal plating film to impart functions such as abrasion resistance. Diamond microparticles having anionic functional groups, such as COOH, are dispersed together with an ionic or nonionic surfactant as dispersing agent to prepare dispersion, and the dispersion is added to a metal plating solution.

EP 1288162 A2 discloses metal plating solution comprising detonation nanodiamonds and a cationic surface-active agent. The detonation nanodiamonds have a large amount of negatively charged functional groups on the nanodiamond particle surface. The cationic surface-active agent is attracted by the negatively charged functional group on the nanodiamond surface, and thus stabilizing the solution.

Based on above disclosure, there is still a need for a more efficient and economical electroless and electrolytic plating methods easy to use and resulting to a metallic coating containing detonation nanodiamonds having improved mechanical, corrosion and thermal properties.

SUMMARY OF THE INVENTION

The present invention relates to an electroless metal plating solution comprising at least one source of metal ions, a reducing agent and detonation nanodiamonds, wherein acid value of the detonation nanodiamonds is less than 5.0.

The present invention further relates to a method for producing an electroless metal plating solution comprising at least one source of metal ions, a reducing agent and detonation nanodiamonds, wherein acid value of the detonation nanodiamonds is less than 5.0, and the method comprises adding detonation nanodiamonds having acid value less than 5.0 to a solution comprising at least one source of metal ions and a reducing agent, and mixing the solution.

Additionally, the present invention relates to an electroless plating method comprising immersing a substrate into a plating bath comprising the electroless metal plating solution comprising at least one source of metal ions, a reducing agent and detonation nanodiamonds, wherein acid value of the detonation nanodiamonds is less than 5.0.

Additionally, the present invention further relates to a metallic coating comprising metal and detonation nanodiamonds, wherein acid value of the detonation nanodiamonds is less than 5.0.

It has now been surprisingly found that by introducing detonation nanodiamonds substantially free of negatively charged functionalities into an electroless metal plating solution, wear and friction properties of formed metal coating are improved significantly. Even better results are obtained when detonation nanodiamonds free of negatively charged functionalities are used.

For example reduction in Taber Wear Index (TWI) which measures the coating's abrasive wear resistance, is at least 10%, preferably at least 100%, more preferably at least 200% compared to a metal coating without the detonation nanodiamonds. The improvements in coating properties are assumed, without binding to any theory, being based on nanodiamond particle ability to optimize the grain size and structure of resulting composite coating.

By using the detonation nanodiamonds substantially free of negatively charged functionalities concentration of the detonation nanodiamonds in the plating solution can be kept low still obtaining improved properties renders the plating method economically feasible.

It was also surprisingly found that by using the detonation nanodiamonds substantially free of negatively charged functionalities, or free of negatively charged functionalities, in an electroless metal plating solution no surfactants are needed to obtain a stable electroless or electrolytic metal plating solution containing the detonation nanodiamonds. That is, there occurs no agglomeration of the detonation nanodiamonds and/or metal ions. Said detonation nanodiamonds can be applied beneficially in both very acidic, mildly acidic, neutral, mildly alkaline and alkaline electrolyte conditions. The nanodiamond additives don't lose their positive charge even at alkaline conditions; the positive charge being and thus, absence of negatively charged surface functions being a necessity for particle additive efficient use in composite coating formation.

It was found that nanodiamonds having negatively charged surface functionalities are interacting with cationic metal atoms in a metal plating solution and thus, form flocculates sedimentating easily to the bottom of the tank. Due to non-optimized overall surface charge the nanodiamond additive loses its capacity to participate in coating formation process. Hence, the lower the content of negatively charged nanodiamond surface functionalities, the better is the nanodiamond additive ability to become part of the formed composite coating, and the higher is the nanodiamond additive stability in the electrolyte itself. Hence, it is advantageous to apply positively charged nanodiamonds as additives in plating electrolytes. The higher the nanodiamond positive charge, the higher is the nanodiamond additive stability (against agglomeration) in the electrolyte. Moreover, the higher is the nanodiamond additive stability in the electrolyte, the less of nanodiamond additive particles are needed in the electrolyte to manufacture the metal coating with improved mechanical, corrosion and thermal properties. The less there are nanodiamond additives in the electrolyte, the less nanodiamonds are used and needed for reaching said improvements in prepared metal coating mechanical, corrosion and thermal properties.

As the nanodiamond additive concentrations in the electrolytes are low, running the plating process becomes easy and reproducible. Moreover, as the nanodiamond additive concentrations can be kept low, there are no detrimental impacts on the electrolyte overall electrical conductivity.

The nanodiamond typical surface functionalities providing the nanodiamond particle positive charge include but are not limited to hydrogen, amine and hydroxyl functionalities.

It was also surprisingly found that the detonation nanodiamonds substantially free of negatively charged functionalities can be dispersed and kept dispersed in the electrolyte without ultrasonication. This is having a positive impact on coating manufacturing overall cost.

Additionally, it was surprisingly found that by subjecting the formed metal coating containing the detonation nanodiamonds to a heat treatment such as annealing process, coating properties can be improved at even higher degree than the respective non-annealed, nanodiamond containing coatings. As nanodiamond additives are having an irreversible impact on coating structure, at least partially impacting the coating mechanical, chemical and thermal properties, the coatings can be also subjected to temperatures higher than the tolerance of nanodiamond additives. The nanodiamond particle oxidation starts at around 450° C., the graphitization in vacuum taking place at 1150° C. and onwards.

It was additionally found that the detonation nanodiamonds substantially free, preferably free, of negatively charged functionalities can be similarly utilized also in electro plating methods. When introducing detonation nanodiamonds substantially free, preferably free, of negatively charged functionalities into an electrolytic metal plating solution, properties of formed metal coating are improved significantly. It was additionally found that the nanodiamonds substantially free, preferably free, of negatively charged functionalities can be similarly utilized beneficially both in very acidic, mildly acidic, neutral, mildly alkaline and alkaline electrolytes.

DETAILED DESCRIPTION OF THE INVENTION

Figure 1:
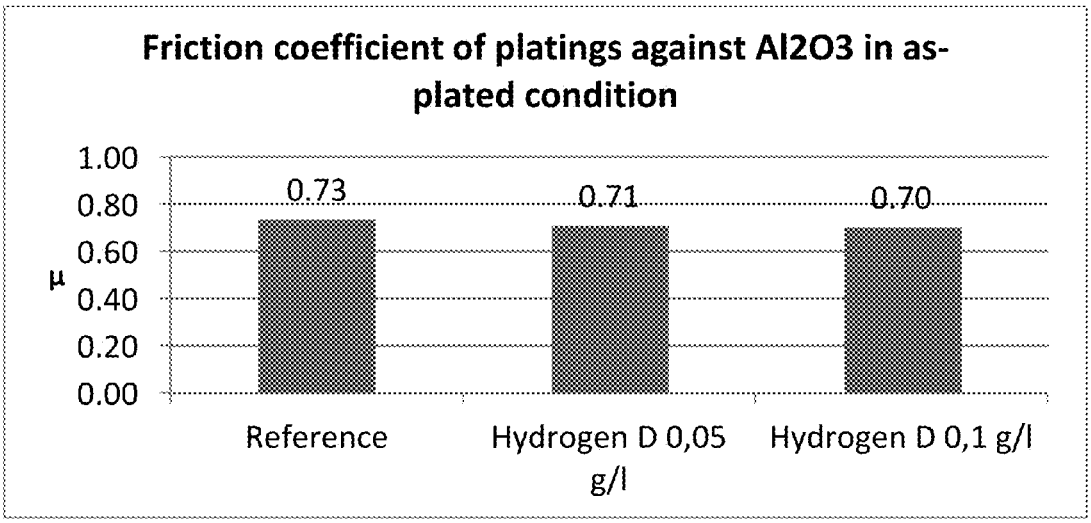
FIG. 1 presents friction coefficients of as-plated samples according to the present invention and reference against $Al_2O_3$.

In a first aspect of the present invention there is provided an electroless metal plating solution. Said metal plating solution can also be an electrolytic metal plating solution.

More particularly there is provided an electroless metal plating solution, also referred as to an electrolyte, comprising at least one source of metal ions and detonation nanodiamonds, wherein the detonation nanodiamonds are substantially free of negatively charged functionalities.

The metal is selected from a group consisting nickel, copper, gold, cobalt, palladium, iron and silver, or mixtures thereof, preferably the metal is nickel.

In one embodiment of the source of nickel ions is selected from a group consisting of nickel sulphate, nickel chloride, nickel acetate, nickel methyl sulfonate, or mixtures thereof.

Amount of the metal in the plating solution can be adjusted depending on the wanted properties of coating forming in the electroless metal plating process. In one embodiment amount of the metal in the plating solution is 0.1-10 g/l, preferably 3-6.5 g/l.

Precursor nanodiamond material may be substantially pure detonation nanodiamond material, preferably having a nanodiamond content of at least 87% by weight, more preferably at least 97% by weight. The detonation nanodiamond may contain graphite and amorphous carbon originating from the production of the detonation nanodiamonds. They may also contain some residual metal impurities, either as metals, metal salts or in metal oxide, nitride or halogenate form.

The detonation nanodiamonds according to this invention are substantially free of negatively charged functionalities. By term "substantially free of negatively charged functionalities" is meant that the applied detonation nanodiamond material acid value is less than 5.0. A comprehensive description on determining the acid value can be found in example section.

The detonation nanodiamond surface contained acidic terminal group can be determined by Boehm titration method. Boehm titration is a widely used method to determine acidic terminal groups on carbon materials. The basic principle of the method is that the surface oxygen groups of carbon material with acidic properties (carboxyl, lactone and phenol) can be identified by neutralizing them with bases of different strengths. The method is most often used to determine the amount of surface carboxyl groups, which can be neutralized with a weak base, sodium bicarbonate ($NaHCO_3$).

In one embodiment the detonation nanodiamond acid value is less than 4.0, preferably less than 3.5, such as 0-3.5.

Examples of negatively charged functionalities include but are not limited to carboxylic acid, sulfonic and nitric acid functionalities and their various salts.

In a preferred embodiment the detonation nanodiamonds are free of negatively charged functionalities, that is, the acid value is 0.

The absence of the nanodiamond surface contained acidic, negatively charged functionalities can be measured and secured by Boehm titration, which method is more comprehensively described in "Rivka Fidel, Evaluation and implementation of methods for quantifying organic and inorganic components of biochar alkalinity, Iowa State University, Digital Repository at Iowa State University, 2012". The method is based on the principle that strong acids and bases will react with all bases and acids, respectively, whereas the conjugate bases of weak acids will accept protons only from stronger acids (i.e. acids with lower pKa values).

Examples of functionalities on detonation nanodiamond that are not negatively charged are hydrogen, amine and hydroxyl termination. Such detonation nanodiamonds are commercially available. In one preferred embodiment the detonation nanodiamond is functionalized with hydrogen and/or amine functionalities.

In one embodiment of the present invention the detonation nanodiamond may include detonation soot such as graphitic and amorphous carbon, the content of oxidisable carbon preferably being at least 5 wt.-%, more preferably at least 10 wt.-%.

Preferably the detonation nanodiamonds are in single digit form. In one embodiment the detonation nanodiamond particles in single digit form have an average primary particle size of from 1 nm to 10 nm, preferably from 2 nm to 8 nm, more preferably from 3 nm to 7 nm, and most preferably from 4 nm to 6 nm. Such particle size can be determined for example by TEM (Tunneling Electron Microscope).

In one embodiment particle size distribution D90 of the detonation nanodiamond dispersion is not more than 100 nm, such as 1-100 nm, preferably not more than 20 nm, such as 1-20 nm, most preferably not more than 12 nm, such as 1-12 nm. Such particle size distribution can be measured for example by dynamic light scattering method.

Amount of the detonation nanodiamonds in the plating solution is 0.005-15 g/l such as 0.01-10 g/l, preferably 0.01-3 g/l, more preferably 0.01-2 g/l, even more preferably 0.01-1 g/l, even more preferably 0.01-0.5 g/l and most preferably 0.01-0.1 g/l such as 0.05 g/l. With g/l of nanodiamonds in plating solution (electrolyte) is meant gram of diamond particles per liter of plating solution (electrolyte).

In one embodiment the detonation nanodiamonds exhibit zeta potential of at least +40 mV, preferably at least +45 mV, more preferably at least +50 mV measured with Laser Doppler Micro-Electrophoresis.

The plating solution may further comprise a reducing agent or several reducing agents. Examples of reducing agents are hypophosphite compounds, such as sodium hypophosphite and boron compounds such as sodium borohydride ($NaBH_4$).

Amount of the reducing agent in the plating solution can be adjusted depending on the wanted properties of coating forming in the electroless metal plating process.

In one embodiment the plating solution may further comprise additional components such as stabilizers, surfactants, brighteners and/or pH adjusting agents. pH of the plating solution can be adjusted to any suitable pH value. In one embodiment the pH is adjusted to 3-6. Suitable pH adjusting agents are e.g. potassium carbonate, ammonium hydroxide and sulphuric acid.

The plating solution may also comprise particles that have effect on properties of final metal coating obtained by the electroless or electrolytic metal plating process. These particles can be soft or hard particles. The soft particles reduces friction coefficient of the coating but impair its abrasive wear and hardness properties. The hard particles enhance hardness and wear of the coating but impair coating friction properties. Examples of soft particles are graphite, graphene, carbon nanotubes, polytetrafluoroethylene (PTFE), hexagonal boron nitride, calcium fluoride and molybdenum disulphide ($MoS_2$). Examples of hard particles are silicon carbide, diamond particles larger than 15 nm, aluminium oxide, silicon dioxide, boron carbide, chromium carbide, titanium carbide and tungsten carbide but also other solid particles. The plating solution may comprise both soft and hard particles such as PTFE and silicon carbide.

In one embodiment the plating solution is free of surfactants.

In a second aspect of the present invention there is provided a method for producing an electroless metal plating solution. Said provided metal plating solution can also be an electrolytic metal plating solution.

More particularly there is provided a method for producing the electroless or electrolytic metal plating solution described above comprising adding detonation nanodiamonds substantially free, preferably free, of negatively charged functionalities to a solution comprising at least one source of metal ions, and mixing the solution.

The detonation nanodiamonds are substantially free of negatively charged functionalities. By term "substantially free of negatively charged functionalities" is meant that the applied detonation nanodiamond material acid value is less than 5.0. The acid value can be measured by potentiometric titration.

In a preferred embodiment the detonation nanodiamonds are free of negatively charged functionalities, that is, the acid value is 0.

The detonation nanodiamonds substantially free of negatively charges functionalities can be added as dry powder to the solution comprising the at least one source of metal ions. Preferably the detonation nanodiamonds are added as an aqueous suspension, more preferably as an aqueous dispersion. With suspension is meant a nanodiamond suspension with particle size distribution D90 higher than 100 nm. With dispersion is meant a nanodiamond suspension with particle size distribution D90 higher at most 100 nm. By particle size distribution D90 is meant that 90% of the particles are smaller than given particle size, and 10% of particles are larger than given particle size.

In a preferred embodiment the detonation nanodiamonds are added as an aqueous dispersion free of surfactants.

In one embodiment the electrolyte is based on water. In another embodiment, the electrolyte is based on an ionic liquid. In the latter embodiment, the nanodiamond powder, suspension or dispersion can be added and mixed into ionic liquid, in one additional embodiment followed by evaporation of nanodiamond dispersion contained water or another solvent. The nanodiamond particles can be also added to ionic liquid prior addition of any other electrolyte components.

The nanodiamond powder, suspension or dispersion can be mixed to a ready electrolyte or to any of the components the electrolyte is manufactured from.

In one embodiment pH of the plating solution is adjusted to 0-14. Preferably the pH is adjusted to 3-6, more preferably 4-6, such as 5.

The mixing of the nanodiamonds into the solution, also referred to as an electrolyte, can be conducted with any suitable method. Examples of such methods are mechanical mixing such as magnetic stirring or ultrasonication. In a preferred embodiment ultrasonication is not used.

In a third aspect of the present invention there is provided an electroless plating method. Said provided metal plating method can also be an electrolytic metal plating method.

More particularly there is provided an electroless plating method comprising immersing a substrate into a plating bath comprising the electroless metal plating solution described above.

In one embodiment the substrate is immersed into the plating bath for 1-360 min, preferably 1-90 min, and most preferably 30-90 min. If manufacturing very thin metal coatings, the substrate can also be immersed to plating bath only for few seconds time. If manufacturing very thick coatings, or applying this method for electroforming purposes, the substrate can be immersed into the plating bath for longer periods of time, including those over 360 minutes.

In one embodiment temperature of the plating bath is 20-100° C., preferably 50-95° C., and more preferably 80-95° C. such as 90° C.

Deposition rate of the metal and nanodiamonds is dependent on various factors, such as phosphorus content of the bath, temperature of the bath, pH of the bath, activity of the bath, agitation and age of the bath.

The substrate can be any suitable substrate. The substrate can be a metal, an alloy, ceramic or a polymer material. In one embodiment the metal is selected from steel, copper, gold, iron, zinc, aluminum, cobalt, nickel, rhodium, palladium and platinum. Akrylenitrilebutadienestryrene (ABS) polymer is an example of suitable polymer.

The substrate can be pretreated before the immersing step. Such pretreatment methods include mechanical cleaning of the substrate i.e. sandblasting, solvent cleaning, hot degreasing and electrocleaning such as cathodic or anodic electrocleaning. The substrate can be subjected to one or several pretreatment methods. After pretreatment, the substrate may be rinsed with for example water. Surface of the substrate may also be activated after the pretreatment steps(s), before the immersing step. For example surface(s) of polymers are preferably activated before the plating.

In one embodiment the substrate is first underplated with a metal, optionally rinsed and then immersed into the plating bath comprising the electroless or electrolytic metal plating solution described above for producing a detonation nanodiamond containing metal layer as the outermost layer. Optionally, additional layer(s) can be plated on the detonation nanodiamond containing metal layer.

In one embodiment, during the electroless or electrolytic plating process pH, reducing agent concentration, metal concentration and detonation nanodiamond concentration are monitored and adjusted if necessary.

In one embodiment the electroless or electrolytic plating method further comprises after treatment step(s), such as rinsing, passivation and/or heat treatment of the formed metallic coating. Preferably the heat treatment is an annealing process. With the annealing process the crystal structure of the metallic coating is modified. The annealing is performed at elevated temperature of 100-1000° C., preferably 100-700° C. such as 400° C. for 15 min-2 hours such as 1 hour. The heat treatment temperature and time varies depending on the desired properties. Annealing can be conducted in air atmosphere or in reducing gas atmosphere such as 95% nitrogen and 5% hydrogen or air can be used. Also the use of inert gas can reduce oxidation of the plating.

In a fourth aspect of the present invention there is provided a metallic coating.

More particularly there is provided a metallic coating, preferably produced with above the process, comprising metal and detonation nanodiamonds, wherein the nanodiamonds are substantially free of negatively charged functionalities.

The detonation nanodiamonds are substantially free of negatively charged functionalities. By term "substantially free of negatively charged functionalities" is meant that the applied detonation nanodiamond material acid value is less than 5.0. The acid value can be measured by potentiometric titration.

In a preferred embodiment the detonation nanodiamonds are free of negatively charged functionalities, that is, the acid value is 0.

In one embodiment the metallic coating is produced with the method disclosed above.

Amount of the detonation nanodiamonds in the metallic coating is 0.01-4.0 wt. %, preferably 0.01-1.0 wt. %, and more preferably 0.01-0.5 wt. % such as 0.2 wt. % based on the total weight of the metallic coating.

In one embodiment the metallic coating has a thickness of 0.01-100 μm, and more preferably 10-30 μm, such as 25 μm.

The metallic coating exhibits reduction in Taber wear index (TWI) compared to a metallic coating without detonation nanodiamonds. The reduction in TWI is at least 10%, preferably at least 50%, more preferably at least 100%, most preferably at least 200% compared to a coating without detonation nanodiamonds.

The metallic coating coefficient of friction is not increased by more than 15%, as compared to coating without detonation nanodiamond additives.

The metallic coating corrosion resistance, as measured by neutral salt spray test, is not reduced by more than 5 $R_p$ units, as compared to coating without nanodiamond additives. What is meant by neutral salt spray test is that steel substrates are plated with a metallic coating of certain material and application related thickness and exposed to 5 wt. % NaCl vapour for a predetermined period of time. The samples are being evaluated for their ability to prevent the steel from rusting. The more detailed description of the test procedure and apparatuses are explained in ASTMB117, EN ISO 9227:2012 and EN ISO 10289:2001 standards.

The metallic coating can be subjected to heat treating, preferably annealing. Such heat treated, preferably annealed, coating exhibits preferably more than 100%, more preferably more than 200% and most preferably more than 300% as reduction in TWI, as compared to metallic coating without detonation nanodiamonds.

The above defined detonation nanodiamonds can also be utilized in electrolytic plating methods. When introducing detonation nanodiamonds substantially free, preferably free, of negatively charged functionalities into an electro metal plating solution, tribological properties, such as wear and hardness and corrosion resistance, of formed metal coating are improved significantly compared to coatings not having detonation nanodiamonds.

The electrolytic (also referred to as electro) metal plating solution comprises at least one source of metal ions and detonation nanodiamonds, wherein the detonation nanodiamonds are substantially free of negatively charged functionalities.

The detonation nanodiamonds are substantially free of negatively charged functionalities. By term "substantially free of negatively charged functionalities" is meant that the applied detonation nanodiamond material acid value is less than 5.0. The acid value can be measured by potentiometric titration.

In a preferred embodiment the detonation nanodiamonds are free of negatively charged functionalities, that is, the acid value is 0. This presence of acidic surface functionalities can be determined by for example potentiometric titration or Boehm titration.

Examples of functionalities on detonation nanodiamond that are not negatively charged are hydrogen, amine and hydroxyl termination. Such detonation nanodiamonds are commercially available. In one preferred embodiment the detonation nanodiamond is functionalized with hydrogen and/or amine functionalities.

In one embodiment the electrolytic metal plating solution further comprises acid. Examples of suitable acids are sulphuric formic, acetic, citric, tartaric and lactic acid.

In other embodiment the electrolytic metal plating solution further comprises suitable basic additive or additives. Examples of suitable bases include but are not limited to ammonium hydroxide and sodium hydroxide.

Examples of chrome metal based electrolytes are hexavalent chrome ($Cr^{6+}$) and trivalent chromium ($Cr^{3+}$). Chromium trioxide is a typical source of hexavalent chrome. Chromium sulphate or chromium chloride are typical sources of trivalent chromium. It is possible to electroplate a large number of other pure metals but also their alloys comprised of two or more metals. The metals and metalloids that can be deposited electrolytically include Mn, Fe, Co, Ni, Cu, Zn, As, Se, Tc, Ru, Rh, Pd, Ag, Cd, In, Sn, Sb, Te, Re, Os, Ir, Pt, Au, Hg, Tl, Pb and Bi. The typical industrial electroplated wear and corrosion resistant coatings include hard chrome, decorative chrome and various nickel coatings. Hard chrome, also known as hexavalent chrome ($Cr^{6+}$) uses chromium trioxide (also known as chromic anhydride) as the main ingredient. Hard chrome can be applied on metal substrates (typical base metals include steel, copper, alloys or aluminium) but also on plastics and ceramics. Its properties include remarkable wear resistance, hardness and low friction properties. Its main applications can be found within oil & gas industries, automotive and aerospace industries and on various industrial machinery parts. The typical coating thickness is 10-50 microns but can be as thick as 500 microns, for example in US produced car shock absorbers.

Amount of the detonation nanodiamonds in the electroplating solution is 0.005-15 g/l, preferably 0.01-3 g/l, more preferably 0.01-2 g/l, even more preferably 0.01-1 g/l, even more preferably 0.01-0.5 g/l and most preferably 0.01-0.1 g/l, such as 0.1 g/l.

The electrolytic plating solution may further comprise additional components such as stabilizers, surfactants, complexing agents, conductive salts, mist suppressants, brighteners, pH buffers and/or pH adjusting agents.

A method for producing an electrolytic plating solution comprises adding of detonation nanodiamonds substantially free, preferably fee, of negatively charged functionalities to a solution comprising at least one source of metal ions, and mixing the solution.

The detonation nanodiamonds substantially free of negatively charges functionalities can be added as dry powder to the solution comprising the at least one source of metal ions and acid. Preferably the detonation nanodiamonds are added as an aqueous suspension, more preferably as an aqueous dispersion.

In a preferred embodiment the detonation nanodiamonds are added as an aqueous dispersion free of surfactants.

In one embodiment pH of the electro plating solution is adjusted before addition of the detonation nanodiamonds.

The mixing can be conducted with any suitable method. Examples of such methods are magnetic stirring or ultrasonication. In a preferred embodiment ultrasonication is not used.

The substrate can be pretreated before the immersing step. Such pretreatment methods are mechanical cleaning of the substrate i.e. sandblasting, solvent cleaning, hot degreasing, electrocleaning and reverse etching. The substrate can be subjected to one or several pretreatment methods. After a pretreatment method the substrate may be rinsed with for example water. Surface of the substrate may also be activated after the pretreatment steps(s), before the immersing step. For example surface(s) of polymers are preferably activated before the plating.

In one embodiment the substrate is first underplated with a metal, optionally rinsed and then immersed into the plating bath comprising the electroless metal plating solution described above for producing a detonation nanodiamond containing metal layer as the outermost layer. Optionally another layer(s) can be plated on the detonation nanodiamond containing metal layer.

An example on electroplating method comprises steps:

i) activating surface of a substrate ii) optionally rinsing the activated surface of the substrate iii) immersing the activated substrate into a electro plating bath comprising the electro plating solution defined above and applying an electric current iv) optionally rinsing at least once the electro plated substrate.

In a preferred embodiment the optional rinsings of steps ii) and iv) are performed.

The substrate can be pretreated before the activation step. Such pretreatment methods are mechanical cleaning of the substrate i.e. sandblasting, solvent cleaning, hot degreasing and electrocleaning. The substrate can be subjected to one or several pretreatment methods. After a pretreatment method the substrate may be rinsed with for example water.

In one embodiment the substrate is first underplated with a metal, optionally rinsed and then immersed into the electro plating bath comprising the electro plating solution defined above for producing a detonation nanodiamond containing metal layer as the outermost layer. Optionally another layer(s) can be plated on the detonation nanodiamond containing metal layer.

The substrate can be any suitable substrate. The substrate can be a metal such as steel, copper, aluminium, an alloy, ceramic or a polymer material, preferably steel, copper or aluminium.

The activation of the surface of the substrate may be conducted in an activation bath. In one embodiment the activation bath comprises acid such as sulphuric acid or chromic acid. In one exemplary embodiment the activation bath comprises chromic acid and with a reverse current is run through it. This etches the substrate surface and removes any scale.

In one embodiment the activation step is done in the electro plating bath comprising the electro plating solution defined above.

The electric current in step iii) may be direct current or alternating current, or the current can be altered to be first direct current and then alternating current, or first alternating current and then direct current. The current can be switched on and off during the plating process.

In one embodiment current density, during the electroplating step iii), is between 10-130 amps per square decimeter.

In the electroplating step iii) the substrate may be immersed in the bath for 5-90 seconds.

In one embodiment temperature of the electroplating bath is 20-70° C.

The electroplated substrate may be rinsed at least once, and optionally dried or passivated.

In one embodiment, during the electro plating process pH, metal concentration and detonation nanodiamond concentration are monitored and adjusted if necessary.

In one embodiment hexavalent chrome, also known as hard chrome is plated on a substrate. The hexavalent chrome ($Cr^{6+}$) uses chromium trioxide (also known as chromic acid anhydride) as the main ingredient. Typical coating thickness is 10-50 microns but can be as thick as 500 microns. In an exemplary embodiment hexavalent chromium plating process comprises process steps: (a) activation, (c) electro plating, (d) at least one rinsing. The activation bath is preferably a tank of chromic acid with a reverse current run through it. This etches the substrate surface and removes any scale. In one embodiment the activation step is done in chromium bath (electro plating bath). The chromium bath comprises chromium trioxide ($CrO_3$) and sulphuric acid, the ratio of which varies between 75:1 to 250:1 by weight, and additionally the detonation nanodiamonds. This results in an acidic bath having pH of 0. Temperature and current density in the bath affect the brightness and final coverage. For hard coating temperature ranges from 40 to 75° C. Temperature is also dependent on the current density, because a higher current density requires a higher temperature. The bath is optionally agitated to keep the temperature steady and achieve a uniform deposition. After the plating process in the chromium bath, the plated substrate having the coating is rinsed at least once.

In one embodiment trivalent chromium is deposited on a substrate The trivalent chromium plating, also known as tri-chrome, $Cr^{3+}$, and chrome (III) plating, uses chromium sulphate or chromium chloride as the main component. A trivalent chromium plating process is similar to the hexavalent chromium plating process, except for the bath chemistry and anode composition. In one embodiment the bath is a chloride- or sulphate-based electrolyte comprising also sulphuric acid and the detonation nanodiamonds using graphite or composite anodes, and additionally additives to prevent oxidation of trivalent chromium to the anodes. In other embodiment the bath is a sulphate-based bath comprising also sulphuric acid and the detonation nanodiamonds that uses lead anodes surrounded by boxes filled with sulphuric acid (known as shielded anodes), which keeps the trivalent chromium from oxidizing at the anodes. Yet in another embodiment the bath is a sulphate-based bath comprising also sulphuric acid and the detonation nanodiamonds that uses insoluble catalytic anodes, which maintains an electrode potential that prevents oxidation. The trivalent chromium-plating process can plate the work-pieces at a similar temperature, rate and hardness, as compared to hexavalent chromium. In one embodiment the plating temperature ranges from 30 to 50° C. Trivalent chrome typical coating thickness ranges from 0.10 to 1.30 μm but can be currently extended to 10 micron thicknesses. In order to replace hexavalent chrome in most of the industrial applications, the coating thickness should reach 100 microns, and in dedicated applications thicknesses beyond 500 microns.

In one embodiment the electroplating method further comprises a step of heat treating the formed metallic coating. Preferably the heat treatment is an annealing process. With the annealing process the crystal structure of the metallic coating is modified. The annealing is performed at elevated temperature of 100-1300° C. such as 400° C. for 15 min-24 hours such as 1 hour. The heat treatment temperature and time varies depending on the desired properties. Annealing can be conducted in air atmosphere or reducing gas such as 95% nitrogen and 5% hydrogen or air can be used. Also the use of inert gas can reduce oxidation of the plating.

In one embodiment the nickel composite coating uses nickel sulphate as its main component, boric acid as pH buffer and proprietary additives to stabilize the bath. The plating temperature can be preferably between 40-50° C., more preferably between 43-47° C., such as 45° C. The plating current can vary between 1-40 A/dm$^2$.

The metallic coating, preferably produced with the above defined electroplating method, comprises metal and detonation nanodiamonds, wherein the nanodiamonds are substantially free, preferably free, of negatively charged functionalities.

Amount of the detonation nanodiamonds in the metallic coating is 0.01-4.0 wt. %, preferably 0.01-1.5 wt. %, more preferably 0.01-0.5 wt. %, and even more preferably 0.01-0.4 wt. % such as 0.2 wt. % based on the total weight of the metallic coating.

Thickness of the metallic coating depends on the deposited metal and process conditions. Coating with noble metal can be up to 0.2 μm, and coatings with chrome can be up to few-several mm.

The metallic coating exhibits reduction in Taber wear index (TWI) compared to a metallic coating without detonation nanodiamonds. The reduction in TWI is at least 50%, preferably at least 100%, more preferably at least 200% compared to a coating without detonation nanodiamonds.

The metallic coating can be subjected to heat treating, preferably annealing. Such heat treated coating exhibits preferably more than 100%, more preferably more than 200% and most preferably more than 300% as reduction in TWI, as compared to metallic coating without detonation nanodiamonds.

In the following the invention will be described in more detail by means of examples. The purpose of the examples is not to restrict the scope of the claims.

EXAMPLES

Apparatuses and Materials

Ultrasonic device: Hielscher UP400S from company Hielscher GmbH. Sonicator tip H22.

Annealing furnace: KERAKO tube furnace from company Keracomp Oy.

Annealing protective gas: Argon.

Ball on disk device: CSM Instrument Tribometer from Company CSM Instruments SA. Measurements were conducted University of Eastern Finland, Joensuu, Finland and at Danmarks Teknologisk Universitet, Kgs. Lyngby, Denmark.

Glow discharge optical emission spectroscopy device: Spectrum Analytic GDA 750 from company Spectruma Analytic Inc. The measurements were conducted at University of Oulu, Oulu, Finland.

Microhardness tester: Future-Tech FM-700 from company Future-Tech Corp. The measurements were conducted at Danmarks Teknologisk Universitet, Kgs. Lyngby, Denmark.

Wear resistance tester: Taber Rotary Abraser 5135 from company Taber Instruments Corporation. The measurements were conducted at Carbodeon's laboratory, Vantaa, Finland.

Salt spray chamber: Q-FOG CCT-1100. The measurements were conducted at Metropolia School of Applied Sciences, Vantaa, Finland. Substrate material for salt spray testing: CR4 steel plates from Company Erichsen, the plates aree in accordance with ISO 3574, for organic coatings in accordance with DIN EN ISO 9227.

Scale: Sartorius CPA324S from Company Sartorius.

Scanning electron microscope: Jeol JSM 5900 from Company JEOL. Imaging was conducted at Danmarks Teknologisk Universitet, Kgs. Lyngby, Denmark.

Tunneling electron microscope: Tecnai Spirit G2 from Company FEI

Abrasive wheels: CS-10 from company Taber Instruments Corporation.

Refacing discs: S-11 from company Taber Instruments Corporation.

Substrate material: Oxygen free copper (CW008).

Electrocleaning bath: Uniclean 251 from Company Atotech GmbH.

Activation bath: Uniclean 675 from Company Atotech GmbH.

Bright nickel electrolyte: Supreme Plus from Company Atotech GmbH.

Electroless nickel bath: Nichem 1122 from Company Atotech GmbH.

Electrolytic nickel plating bath: Scanimet® from Company Atotech GmbH.

Silicon carbide particles: Scanimet® silicon carbide.

Applied detonation nanodiamond additives:

Hydrogen D is hydrogen functionalized detonation nanodiamond, available in its aquous dispersion form but also in a range of polar organic solvents. Hydrogen D contained nanodiamonds are also available as powder grade product, under product name Hydrogen P. Hydrogen D and P products are commercially available from Carbodeon Ltd Oy, Finland. Hydrogen P and D products exhibit highly positive zeta potential, the commercial products exhibiting minimum+50 mV zetapotential. The aquous nanodiamond dispersion is agglomeration-free at pH 3 to 9 and exhibits higher positive zeta potential also at very acidic conditions than for example Carbodeon commercial nanodiamond dispersion uDiamond Andante. Hydrogen D in water nanodiamond concentration is 2.5 wt. %, i.e. one liter of Hydrogen D nanodiamond dispersion contains 25 grams of nanodiamond particles.

Amine D is amine functionalized detonation nanodiamond, available in its aquous dispersion form but also in a range of polar organic solvents. Amine D contained nanodiamonds are also available as powder grade product, under product name Amine P. Amine D and P products are commercially available from Carbodeon Ltd Oy, Finland. Amine P and Amine D products exhibit highly positive zeta potential, the commercial products exhibiting minimum+50 mV zeta potential. Amine D in water nanodiamond concentration is 0.5 wt. %, i.e. one liter of Amine D nanodiamond dispersion contains 5 grams of nanodiamond particles.

Vox D is carboxyl functionalized detonation nanodiamond, available in its aquous dispersion form but also in a range of polar organic solvents. Vox D contained nanodiamonds are also available as powder grade product, under product name Vox P. Vox D and P products are commercially available from Carbodeon Ltd Oy, Finland. Vox P and Vox D products exhibit highly negative zeta potential, the commercial products exhibiting minimum−50 mV zeta potential. The aquous nanodiamond dispersion is agglomeration-free at pH 5 to 12. Vox D in water nanodiamond concentration is 5.0 wt. %, i.e. one liter of Vox D nanodiamond dispersion contains 50 grams of nanodiamond particles.

The applied detonation nanodiamond material can be which ever detonation nanodiamond material exhibiting acid value less than 5.0. Commercial detonation nanodiamond dispersion uDiamond Andante acid value is >5.0 and its introduction efficient introduction to applied metal electrolytes requires the use of ultrasonication. Moreover, the surface contained acidic functions, including carboxylic acid functionalities, cause flocculation of electrolyte contained metal ions. The aqueous Andante detonation nanodiamond additive is is agglomeration-free at pH 3 to 6. The uDiamond Andante nanodiamond concentration is 5 wt. %, i.e. one liter of Andante nanodiamond dispersion contains 50 grams of nanodiamond particles. The acid value can be measured by potentiometric titration.

Measurement of Detonation Nanodiamond Acid Values by Potentiometric Titration

The detonation nanodiamond powder and dispersion acid values can be measured by potentiometric titration which process includes the next steps: Every sample measurement was conducted twice, with a sample size of 1.5 g per titration. The titrations were carried out with automated Metrohm titrator. Determination of acid functions: Solid samples were weighted accurately (1.5 g). The prepared samples were dispersed into 75 ml of neutralized ethanol (water content 0.5 wt. %), using Hielscher 400 W ultrasonic unit. The prepared samples were titrated with 0.1 M KOH (in methanol), using phenoliftalene as an indicator. The samples were treated continuously with Argon gas flow during the titration. The titration end point was detected by using an indicator and with potentiometric means, using Methrohm Solvotrode electrode and drawing a titration curve. The acid value is determined as milligram amount of KOH (potassium hydroxide) required neutralize the acidic functionalities in 1 g of nanodiamond material. The measurement can be interfered by aqueous phase contained various carbonates and thus, measure values higher than the studied detonation nanodiamond samples would exhibit.

The studied carboxylated nanodiamond powder sample, known also as Vox P product exhibited an acid value of 34.7. The studied carboxylated nanodiamond aqueous dispersion sample, known also as Vox D in water product exhibited an acid value of 30.2.

The studied hydrogenated nanodiamond powder sample, known also as Hydrogen P product exhibited an acid value of 1.3. The studied hydrogenated nanodiamond aqueous dispersion sample, known also as Hydrogen D in water product exhibited an acid value of 1.8.

The studied amine-terminated nanodiamond powder sample, known also as Amine P product exhibited an acid value of 3.0. The studied hydrogenated nanodiamond aqueous dispersion sample, known also as Amine D in water product exhibited an acid value of 3.1.

Boehm Titration to Determine Detonation Nanodiamond Surface Contained Acidic Functional Groups The General Method:

1.5 g of detonation nanodiamond powder is mixed into 50 ml ($V_B$) of 0.05 M ($c_B$) $NaHCO_3$ solution. The mixture is shaken for 24 hours to let the base neutralize all of the surface carboxyl groups of the nanodiamonds. Solution is then centrifuged for 30 minutes with relative centrifugal force (RCF) of 8240. Further, solution is filtered through a 0.8 μm membrane to extract all the diamond particles. A back-titration method is used to determine the amount of $NaHCO_3$ molecules that have been neutralized by the carboxyl groups. In order to execute the back-titration, 10 ml ($V_a$) of the filtered sample is neutralized with 20 ml of 0.05 M HCl solution. This new mixture is degassed for 2 hours with argon flux through the sample, to avoid the error caused by dissolved $CO_2$. The degassed sample is finally titrated with 0.05 M NaOH solution. Since HCl is a strong base and NaOH is a strong acid the equivalent point of the titration is set to be 7.00.

For the back-titration the amount of the carboxyl groups can be determined by:

$$n_{CSF} = \frac{n_{HCl}}{n_B} c_B V_B - \frac{V_B}{V_a}(c_{HCl} V_{HCl} - c_{NaOH} V_{NaOH})$$

Where $n_{CSF}$ stands for the amount of the carbon surface functionalities, $c_B$ and $V_b$ are the concentration and volume of the base mixed with the diamond powder, and $V_a$ is the volume of the sample neutralized with the HCl solution. Ratio $n_{HCl}/n_B$ is the stoichiometric factor of the reaction chemistry, in sodium bicarbonate's case it equals 1. The resulting $n_{CSF}$ is further divided by the carbon material mass, thus the unit of the result will be μmol/g.

Hydrogen P Detonation Nanodiamond Powder:

Boehm titration method was applied to measure the amount of acidic groups on Carbodeon's uDiamond Hydrogen P detonation powder. The determined result was −73.9 μmol/g. The negative result can be explained by the fact that when Hydrogen P nanodiamond powder is mixed with water, the slurry is basic (pH>7). The Hydrogen P powder by itself increases the amount of hydroxyl groups that need to be neutralized by HCl in the back-titration. Thus the result is negative and it can be concluded that Hydrogen P nanodiamond powder is free from carboxylic groups.

Preparation of Detonation Nanodiamond Containing Electroless Nickel Electrolyte Using Ultrasonic Mixing The electroless nickel electrolyte (electroless nickel plating solution) was prepared according to the supplier's instructions. The pH of the electrolyte was adjusted to 5 and was left to stir overnight in order to stabilize the bath. 1 liter of room temperature electrolyte was taken into 2 liter beaker. Detonation nanodiamond dispersion was pipetted into electrolyte and ultrasonic mixing was performed for 10 minutes with full power. This procedure was repeated 5 times in order to make 5 liters of detonation nanodiamond containing electrolyte.

Preparation of Detonation Nanodiamond Containing Electroless Nickel Electrolyte Using Ultrasonic Mixing The electroless nickel electrolyte (electroless nickel plating solution) was prepared according to the suppliers instructions. The pH of the electrolyte was adjusted to 5 and was left to stir overnight in order to stabilize the bath.

1 liter of room temperature electrolyte was taken into 2 liter beaker. Detonation nanodiamond dispersion was pipetted into electrolyte and ultrasonic mixing was performed for 10 minutes with full power. This procedure was repeated 5 times in order to make 5 liters of detonation nanodiamond containing electrolyte.

Preparation of Detonation Nanodiamond Containing Electroless Nickel Electrolyte without Ultrasonic Mixing The electroless nickel electrolyte (electroless nickel plating solution) was prepared according to the supplier's instructions. The pH of the electrolyte was adjusted to 5 and the resulting electrolyte was left to stir overnight in order to stabilize the bath.

The desired amount of detonation nanodiamonds was measured into small beaker and diluted with 250 ml of DI-water and stirred gently. This diluted dispersion was added into the electroless nickel bath and left to mix using magnetic stirring for 15 minutes before heating the bath to operation temperature.

Preparation of Detonation Nanodiamond Containing Electrolytic Nickel Electrolyte Using Ultrasonic Mixing The electrolytic nickel electrolyte was prepared so that first 500 g/l of Scanimet Nickel salt $NiSO_4(H_2O)_6$ was dissolved into DI-water. Then 40 g/l of Boric acid was dissolved and finally 16.5 ml/l of Scanimet TA additive was added and mixed thoroughly. Detonation nanodiamond dispersion was pipetted into electrolyte and ultrasonic mixing was performed for 10 minutes. Silicon carbide particles that were also tested were not sonicated once added.

Plating Procedure for Electroless Nickel Samples

The plating of the samples was done according to process route described below:

Cathodic electrocleaning 20 s, 2 A/dm$^2$→2 rinses with DI-water→Activation 20 s, room temperature→rinse with DI-water→Bright nickel strike 90 s, 55° C., 4 A/dm$^2$→2 rinses with DI-water→Activation 20 s→rinse→Electroless nickel plating 1 hour, 89° C.±1° C.

The pH and the nickel concentration of the electrolyte were monitored and adjusted according to the manufacturer's instruction and were held within the limits set by the manufacturer.

Plating Procedure for Electrolytic Nickel Samples

The copper plates were degreased cathodically for 3 minutes, activated in DeWeKa dry acid and electroplated in nickel SLOTONIK 40® at a current density of 3.5 A/dm$^2$ at 55° C. with stirring for 11.5 minutes.

The electrolytic nickel-nanodiamond composite was plated using 30 A/dm$^2$ current density and plated for 30 minutes.

Heat Treatment Procedure (Annealing)

Heat treatment was performed at 400° C. for 1 hour under argon atmosphere to prevent oxidation of the nickel coating. The heat treatment temperature and time can vary depending on the desired properties. It is well known for anyone skilled in the art that electroless nickel phosphorous form partly amorphous coating that's crystallinity can be modified using heat treatment process. It is also known that the protective gas can also be reducing gas such as 95% nitrogen and 5% hydrogen, or air can also be used.

Wear Resistance Measurements

Wear resistance measurements were conducted using Taber abraser 5135 rotary abraser. CS-10 abrasive rollers with 1 kg weight were used. The test length was 6000 revolutions, and the substrate was measured every 1000 revolutions. Average weight loss in mg per 1000 revolutions (excluding the first 1000 revolutions) is the Taber Wear Index of the plating. After every 1000 revolutions the abrasive rollers were resurfaced. The test follows ASTM B733 standard but differs in coating thickness and substrate material.

Microhardness Measurements

Vickers microhardness measurements were conducted using Future-Tech FM-700 microhardness tester with 10 gram load.

Determination of Carbon Content in the Coating

The carbon (diamond) content measurements were conducted at University of Oulu, Finland, using glow discharge optical emission spectroscopy (GDOES) which gives the carbon content throughout the coating thickness.

Example 1

Nanodiamond Hydrogen D in water was dispersed into electrolyte using ultrasonic mixing in concentrations 0.05 g/l and 0.1 g/l (as calculated in nanodiamond concentration) and plated using the abovementioned route. With 0.05 g/l is meant 0.05 grams of nanodiamond particles in one liter of electrolyte. With 0.1 g/l is meant 0.1 grams of nanodiamond particles in one liter of electrolyte. Both annealed an as-plated samples were tested for their wear resistance. Results are presented in Table 1. The panel plated with 0.05 g/l of Hydroged D contained nanodiamond particles gave 216% improved wear resistance and the panel plated with 0.1 g/l of Hydrogen D contained nanodiamond particles gave 252% improved wear resistance, as compared to reference sample plated without Hydrogen D nanodiamond additive. The annealed panel with 0.05 g/l of Hydrogen D contained nanodiamond particles gave 296% improvement in coating wear resistance. The annealed panel with 0.1 g/l of Hydrogen D contained nanodiamond particles gave 346% improvement in coating wear resistance, as compared to annealed reference sample plated without Hydrogen D nanodiamond additive.

TABLE 1

| | TWI, as-plated | TWI, annealed |
|---|---|---|
| Hydrogen D 0.05 g/l | 5.8 | 2.7 |
| Hydrogen D 0.1 g/l | 5.2 | 2.4 |

Example 2

Nanodiamond Amine D in water was dispersed into electrolyte using ultrasonic mixing in concentrations 0.05 g/l and 0.1 g/l (as calculated in nanodiamond concentration) and plated using the abovementioned route. both annealed an as-plated samples were tested for their wear resistance. Results are presented in Table 2. The panel plated with 0.05 g/l of Amine D contained nanodiamond particles gave 195% improved wear resistance and the panel plated with 0.1 g/l of Amine D contained nanodiamond particles gave 216% improved wear resistance, as compared to reference sample plated without Amine D nanodiamond additive. The annealed panel with 0.05 g/l of Amine D contained nanodiamond particles gave 282% improvement in coating wear resistance. The annealed panel with 0.1 g/l of Amine D contained nanodiamond particles gave 406% improvement in coating wear resistance, as compared to annealed reference sample plated without Amine D nanodiamond additive.

TABLE 2

| | TWI, as-plated | TWI, annealed |
|---|---|---|
| Amine D 0.05 g/l | 6.2 | 2.8 |
| Amine D 0.1 g/l | 5.8 | 2.1 |

Example 3

Reference

Nanodiamond dispersion Vox D in water was dispersed into electrolyte using ultrasonic mixing in concentration 0.05 g/l (as calculated in nanodiamond concentration) and plated using the abovementioned route. The as-plated samples were tested for their wear resistance. Results are presented in Table 3. The result clearly demonstrates the nanodiamond surface contained carboxylic acid and other acidic functions impairing effect on coating wear resistance properties. The panel plated with 0.05 g/l of Vox D contained nanodiamonds gave only 49% improvement in wear resistance, which result is well in line with published data but with significantly higher nanodiamond concentrations.

TABLE 3

| | TWI, as-plated |
|---|---|
| Vox D 0.05 g/l | 12.3 |

Example 4

Nanodiamond Hydrogen D was dispersed into electrolyte without using ultrasonic mixing in concentration 0.1 g/l (as calculated in nanodiamond concentration) and plated using the abovementioned route. Both annealed an as-plated samples were tested for their wear resistance. The panel plated with 0.1 g/l of Hydrogen D contained nanodiamond particles gave 221% improved wear resistance, as compared to reference sample plated without Hydrogen D nanodiamond additive. The annealed panel with 0.1 g/l of Hydrogen D contained nanodiamond particles gave 312% improvement in coating wear resistance, as compared to annealed reference sample plated without Hydrogen D nanodiamond additive. Results are presented in Table 4. The result clearly indicates there is no need for using ultrasonication for getting the nanodiamonds dispersed into electrolyte but the similar performance can also be reached without ultrasonication step.

TABLE 4

| | TWI as-plated | TWI annealed |
|---|---|---|
| Hydrogen D 0.1 g/l | 5.7 | 2.6 |

Example 5

Nanodiamond Amine D was dispersed into electrolyte without using ultrasonic mixing in concentrations 0.05 g/l and 0.1 g/l (as calculated in nanodiamond concentration) and plated using the abovementioned route. Both annealed an as-plated samples were tested for their wear resistance. The panel plated with 0.1 g/l of Amine D contained nanodiamond particles gave 190% improved wear resistance, as compared to reference sample plated without Amine D nanodiamond additive. The annealed panel with 0.05 g/l of Amine D contained nanodiamond particles gave 157% improvement in coating wear resistance. The annealed panel with 0.1 g/l of Amine D contained nanodiamond particles gave 365% improvement in coating wear resistance, as compared to annealed reference sample plated without Amine D nanodiamond additive. Results are presented in Table 5.

TABLE 5

| | TWI as-plated | TWI annealed |
|---|---|---|
| Amine D 0.05 g/l | — | 3 |
| Amine D 0.1 g/l | 6.3 | 2.3 |

Example 6

Reference

Reference samples were plated using the abovementioned route, however the plating solution did not contain any nanodiamonds. Both annealed an as-plated samples were tested for their wear resistance. Results are presented in Table 6.

TABLE 6

| | TWI as-plated | TWI annealed |
|---|---|---|
| Reference | 18.3 | 10.7 |

As can be seen from the tables 1-6, the samples according to the present invention gave better TWI results than the Reference samples. The improvements are even more pronounced within the annealed samples.

Carbon Content Analyses

The carbon content was measured using glow discharge optical spectroscopy method. The carbon analysis results are presented in Table 7. By "sonicated" is meant ultrasonic tool was applied during introduction of nanodiamonds into electrolyte. Ultrasonication was not applied during actual sample plating. By unsonicated is meant no ultrasonic tools were applied during introduction of nanodiamonds to the electrolyte, nor during sample plating.

TABLE 7

| Sample | Carbon content [wt-%] |
|---|---|
| Hydrogen D 0.05 g/l sonicated | 0.15 |
| Hydrogen D 0.1 g/l sonicated | 0.28 |
| Hydrogen D 0.1 g/l unsonicated | 0.28 |
| Amine D 0.1 g/l unsonicated - sample 1 | 0.22 |
| Amine D 0.1 g/l unsonicated - sample 2 | 0.16 |

Friction Coefficient Measurement Results

Friction coefficient measurements were conducted with ball on disk method. Samples were plated and the friction coefficient was measured against $Al_2O_3$ and hardened steel ball. Temperature in which the measurements were conducted was 24±1° C. The applied force was 2N and the rotation speed was 5 cm/s. The results are presented in FIGS. 1-3.

FIG. 1 presents friction coefficients of as-plated samples according to the present invention and reference against $Al_2O_3$.

Figure 2:
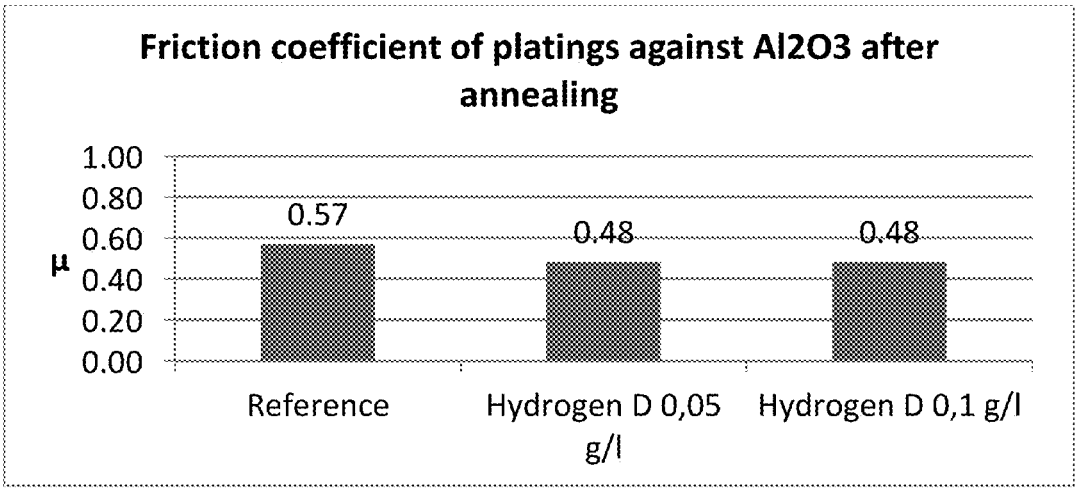
FIG. 2 presents friction coefficients of samples according to the present invention and reference annealed in 400° C. for 1 hour against $Al_2O_3$.

FIG. 2 presents friction coefficients of samples according to the present invention and reference annealed in 400° C. for 1 hour against $Al_2O_3$.

Figure 3:
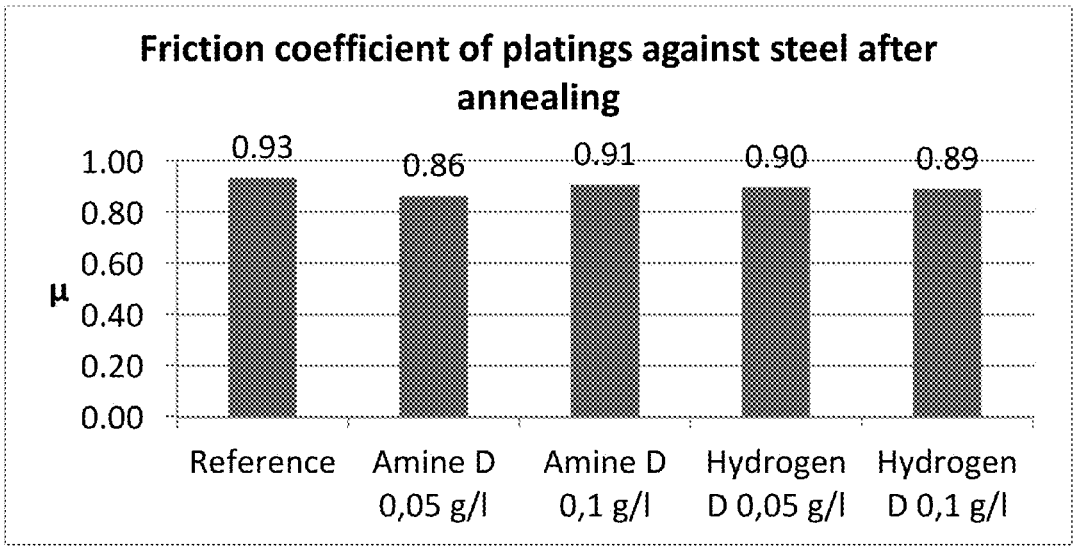
FIG. 3 presents friction coefficients of samples according to the present invention and reference annealed in 400° C. for 1 hour against steel.

FIG. 3 presents friction coefficients of samples according to the present invention and reference annealed in 400° C. for 1 hour against steel.

As can be seen from the FIGS. 1-3 the plated samples according to the present invention gave resulted in lower coefficient of friction than the reference samples.

Corrosion Resistance Measurements

The corrosion resistance of plated electroless nickel samples measured with neutral salt spray (96 hours). The plating was deposited on Erichsen steel panels to a thickness of 25.4 μm±2 μm. The plating was conducted in a following manner:

Ethanol cleaning of the substrate, rinse, anodic electrocleaning—Uniclean 251 4 A/dm2 120 s, 2 rinses, activation—Uniclean 675 20 s, 2 rinses, electroless nickel plating—Atotech Nichem 1122 to 25.4 μm.

The prepared samples were visually inspected for their ability to protect the steel layer (formation of red rust). After 96 hours the samples were rinsed with tap water and dried with pressurized air. The results of the tests are presented in Table 8.

TABLE 8

Corrosion protection ability of electroless nickel coatings with and without nanodiamonds.

| Sample | Thickness [μm] | Rp-value |
|---|---|---|
| Reference, annealed | 24.3 | 9 |
| Reference, annealed | 25.8 | 9 |
| Reference, as-plated | 26.1 | 9 |
| Reference, as-plated | 25.5 | 9 |
| Amine D, 0.1 g/l, no sonication, annealed | 24.7 | 9 |
| Amine D, 0.1 g/l, no sonication, annealed | 25.1 | 9 |
| Amine D, 0.1 g/l, no sonication, annealed | 24.5 | 9 |
| Hydrogen D, 0.1 g/l, no sonication, annealed | 26.7 | 9 |
| Hydrogen D, 0.1 g/l, no sonication, annealed | 26.4 | 9 |
| Hydrogen D,0.1 g/l, no sonication, annealed | 23.0 | 9 |
| Hydrogen D, 0.1 g/l, no sonication, annealed | 26.8 | 9 |
| Hydrogen D, 0.05 g/l, ultrasonicated, annealed | 23.7 | 9 |
| Hydrogen D, 0.05 g/l, ultrasonicated, annealed | 24.7 | 9 |
| Hydrogen D, 0.05 g/l, ultrasonicated, annealed | 23.7 | 8 |
| Hydrogen D, 0.05 g/l, ultrasonicated, as-plated | 25.6 | 8 |
| Hydrogen D, 0.05 g/l, ultrasonicated, as-plated | 25.7 | 8 |
| Hydrogen D, 0.05 g/l, ultrasonicated, as-plated | 27.3 | 8 |
| Hydrogen D, 0.05 g/l, ultrasonicated, as-plated | 27.2 | 8 |
| Hydrogen D, 0.05 g/l, ultrasonicated, annealed | 24.6 | 8 |
| Hydrogen D, 0.1 g/l, ultrasonicated, annealed | 24.5 | 8 |
| Hydrogen D, 0.1 g/l, ultrasonicated, as-plated | | 8 |
| Hydrogen D, 0.1 g/l, ultrasonicated, as-plated | | 8 |
| Hydrogen D, 0.1 g/l, ultrasonicated, as-plated | | 8 |
| Hydrogen D, 0.1 g/l, ultrasonicated, as-plated | | 8 |
| Hydrogen D, 0.1 g/l, no sonication, as-plated | 24.3 | 8 |
| Amine D, 0.1 g/l, no sonication, as-plated | 25.8 | 8 |
| Amine D, 0.1 g/l, no sonication, as-plated | 24.2 | 8 |
| Amine D, 0.1 g/l, no sonication, as-plated | 24.2 | 8 |
| Amine D, 0.1 g/l, no sonication, annealed | 24.8 | 8 |
| Hydrogen D, 0.1 g/l, no sonication, as-plated | 23.7 | 7 |
| Hydrogen D, 0.1 g/l, no sonication, as-plated | 24.2 | 7 |
| Amine D, 0.1 g/l, no sonication, as-plated | 26.0 | 7 |
| Hydrogen D, 0.1 g/l, no sonication, as-plated | 23.7 | 6 |

Example 7

Electrolytic Nickel

Nanodiamond Hydrogen D was dispersed into the bath as stated above in concentrations 0.01 g/l, 1 g/l and 7.5 g/l (as calculated in nanodiamond concentration). Silicon carbide particle concentration in SiC-bath was 40 g/l and reference Ni contained neither particles. All baths were plated using 30 A/dm$^2$ for 30 minutes. Plating was conducted in beaker using platinized Titanium web as anode.

Figure 4:
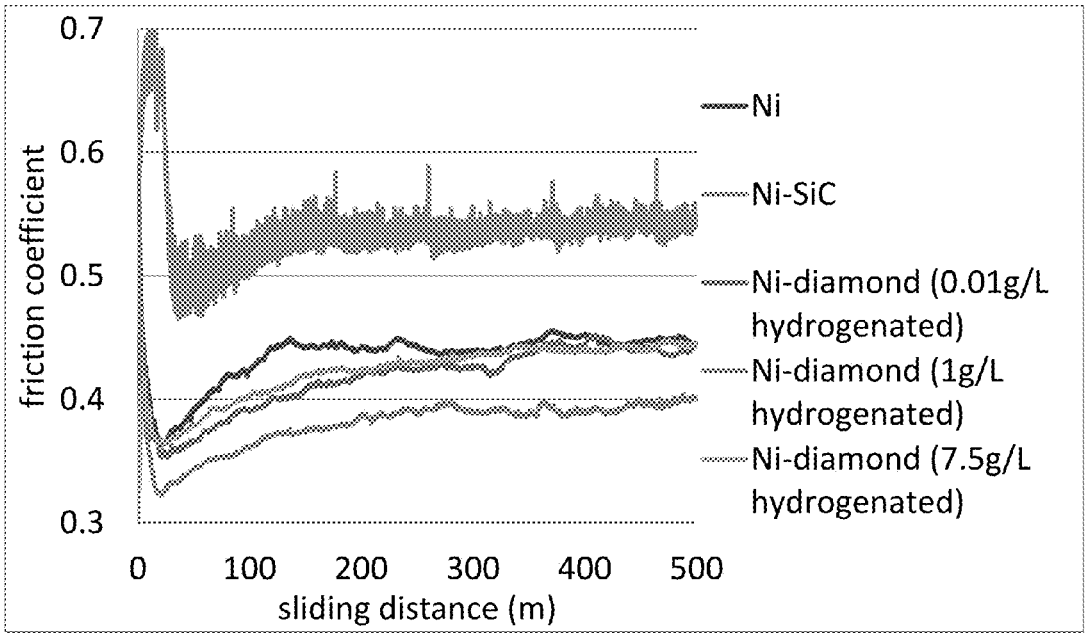
FIG. 4 presents friction coefficients of electrolytic nickel, Ni—SiC, Ni-ND 0.01 g/, Ni-ND 1 g/l and Ni-ND 7.5 g/l according to the present invention.

FIG. 4 shows friction coefficients for all samples against $Al_2O_3$ ball. The length of the test was 500 meters, the force used was 10N and the speed was 10 cm/s. From FIG. 4 it can be seen that all ND-composite coatings exhibit better wear resistance compared to Ni or Ni—SiC coatings. It is also visible that the addition of detonation nanodiamond particles in the coating doesn't increase the surface roughness as SiC-particles do.

Figure 5A:
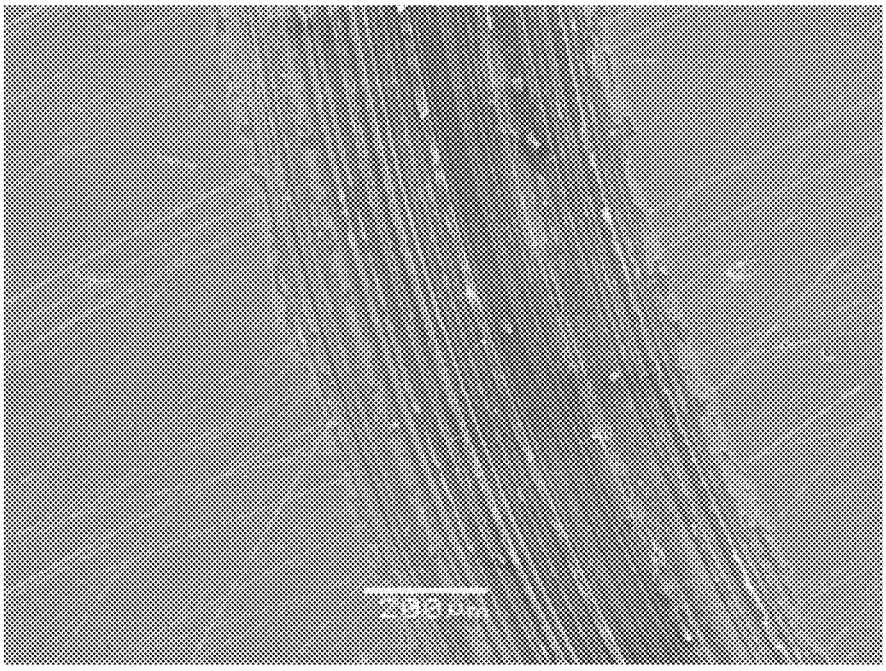
FIGS. 5*a* and 5*b* presents SEM images of wear tracks of electrolytic nickel and Ni-ND Hydrogen D 7.5 g/l according to the present invention.
Figure 5B:
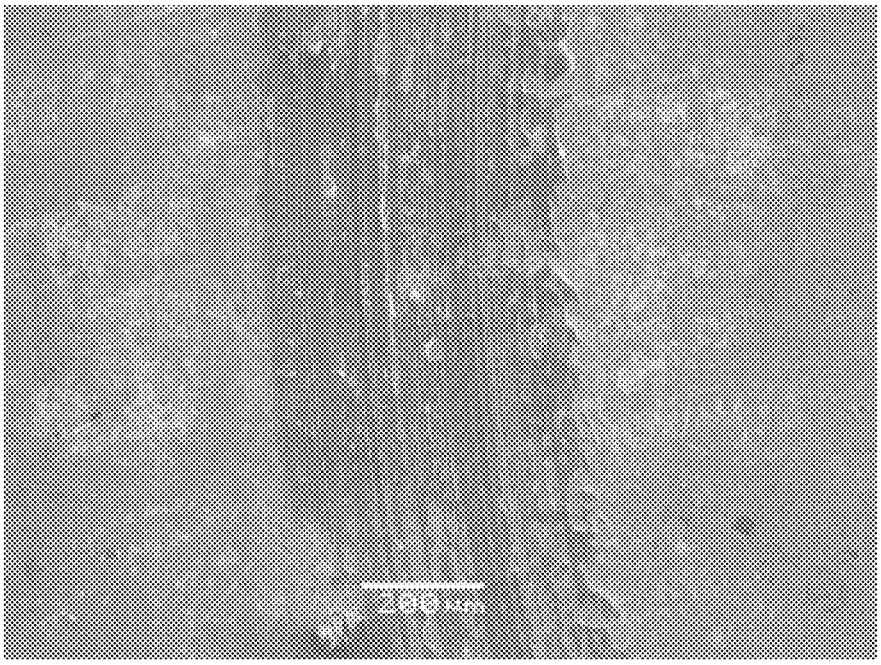

FIGS. 5*a* and 5*b* show wear tracks imaged with SEM for electrolytic nickel and Ni-ND 7.5 g/l. By looking at the width of the wear track and its appearance, it is clear that nanodiamond containing coating (FIG. 5*b*) has higher wear resistance.

The FIG. 5*a* features a wear track for a coating plated from pure electrolytic nickel, the FIG. 5*b* featuring a wear track manufactured from an electrolyte with 7.5 g/l of Hydrogen D contained detonation nanodiamonds.

The invention claimed is:

1. An electroless metal plating solution comprising at least one source of metal ions, a reducing agent and detonation nanodiamonds, wherein acid value of the detonation nanodiamonds is less than 5.0 and the detonation nanodiamonds exhibit zeta potential at +40 mV.

2. The electroless metal plating solution according to claim 1, wherein the metal is selected from the group consisting of nickel, copper, gold, cobalt, palladium, iron, silver, and mixtures thereof.

3. The electroless metal plating solution according to claim 2, wherein the metal is nickel.

4. The electroless metal plating solution according to claim 1, wherein amount of the detonation nanodiamonds in the plating solution is 0.005-15 g/l.

5. The electroless metal plating solution according to claim 1, wherein particle size distribution D90 of the detonation nanodiamond added to the plating solution is not more than 100 nm.

6. The electroless metal plating solution according to claim 1, wherein acid value of the detonation nanodiamonds is 0.

7. The electroless metal plating solution according to claim 1, wherein the solution further comprises additional components selected from the group consisting of graphite, graphene, carbon nanotubes, diamond particles larger than 15 nm, boron carbide, chromium carbide, calcium fluoride, tungsten carbide, titanium carbide, polytetrafluoroethylene (PTFE), boron nitride, silicon carbide, aluminium oxide, silicon dioxide, any other solid particle additives and mixtures thereof.

8. A method for producing the electroless metal plating solution according to claim 1, said method comprising the steps of adding detonation nanodiamonds having acid value less than 5.0 zeta potential at least +40 mV, to a solution comprising at least one source of metal ions and a reducing agent; and mixing the solution.

9. The method according to claim 8, wherein the detonation nanodiamonds are added as aqueous dispersion.

10. The method of claim 9, wherein the aqueous dispersion is free of surfactants.

11. The method according to claim 8, wherein particle size distribution D90 of the detonation nanodiamond dispersion added to the electrolyte is not more than 100 nm.

12. An electroless plating method comprising immersing a substrate into a plating bath comprising the electroless metal plating solution according to claim 1.

13. The electroless plating method according to claim 12, wherein the method further comprises step of heat treating the formed plating.

14. A metallic coating comprising metal and detonation nanodiamonds, wherein acid value of the detonation nanodiamonds is less than 5.0 and the detonation nanodiamonds exhibit zeta potential at least +40 mV.

15. The metallic coating according to claim 14, wherein the acid value of the detonation nanodiamonds is 0.

16. The metallic coating according to claim 14, wherein amount of the detonation nanodiamonds is 0.01-4.0 wt. % based on the total weight of the coating.

17. The metallic coating according to claim 14, wherein reduction in Taber Wear Index (TWI) is at least 10% as compared to a metallic coating without detonation nanodiamonds.

18. The metallic coating according to claim 14, wherein coating coefficient of friction is not increased by more than 15%, as compared to coating without detonation nanodiamond additives.

19. The metallic coating according to claim 14, wherein coating corrosion resistance, as measured by neutral salt spray test, is not reduced by more than 5 $R_p$ units, as compared to coating without nanodiamond additives.

20. The metallic coating according to claim 14, wherein the coating has been subjected to heat treating.

21. The metallic coating according to claim 20, wherein reduction in TWI is more than 100%, as compared to metallic coating without detonation nanodiamonds.

* * * * *